United States Patent [19]

Guitay

[11] Patent Number: 4,729,368

[45] Date of Patent: Mar. 8, 1988

[54] APPARATUS FOR MASSAGING THE HUMAN BODY

[76] Inventor: Louis P. Guitay, 1 avenue Victor Hugo, 26000 Valence, France

[21] Appl. No.: 929,430

[22] Filed: Nov. 12, 1986

[30] Foreign Application Priority Data

Nov. 14, 1985 [FR] France ..... 85 17026

[51] Int. Cl.[4] ..... A61H 15/00

[52] U.S. Cl. ..... 128/57; 15/415 R; 128/59

[58] Field of Search ..... 128/56–59; 15/415 R

[56] References Cited

U.S. PATENT DOCUMENTS

| | | | |
|---|---|---|---|
| 1,663,167 | 3/1928 | Koester | 128/57 |
| 2,819,715 | 1/1958 | Calhoun | 128/57 |
| 3,297,024 | 1/1967 | Robinson | 128/38 |

FOREIGN PATENT DOCUMENTS

| | | | |
|---|---|---|---|
| 727291 | 6/1932 | France . | |
| 934070 | 1/1948 | France | 128/57 |
| 991781 | 6/1951 | France | 128/57 |
| 1590131 | 3/1970 | France . | |
| 2057514 | 5/1971 | France . | |
| 206851 | 11/1939 | Switzerland . | |
| 926968 | 5/1963 | United Kingdom | 15/415 R |

*Primary Examiner*—Clyde I. Coughenour
*Attorney, Agent, or Firm*—Parkhurst & Oliff

[57] ABSTRACT

This invention relates to an apparatus for massaging the human body, comprising, mounted inside a manually operated housing, two parallel active rollers, preferably driven in rotation by a motor, said housing being connected to means for creating a depression above the rollers, in which apparatus the two active rollers are normally maintained in spaced apart relationship with respect to each other via return means (springs); and the depression created within the housing is exerted solely in the space between the rollers during use of the apparatus and tends not only to suck the skin so that it can be treated, but also automatically to bring the rollers closer to each other to ensure the pinching action on the fold of skin formed.

15 Claims, 6 Drawing Figures

APPARATUS FOR MASSAGING THE HUMAN BODY

BACKGROUND OF THE INVENTION

The present invention relates to an improved apparatus for massaging the human body.

Various massaging techniques are used as a function of the treatments to be undergone. The massaging operations generally involve subjecting the patient to stresses such as pressure, and/or displacements and/or pinchings.

Various types of equipment have been proposed up to the present time to facilitate the masseur's work. In general, such equipment exert on the body an action of pressure, of displacement, of friction by vibrations, but in no case do they make it possible to obtain the combined stresses involved in the so-called "rolled palpation" massaging technique used in particular in the case of treatment of cutaneous, cellulitic and dermalgic zones. The "rolled palpation" technique involves subjecting the patient to a continuous action during which the masseur must effect, simultaneously, not only a localized pinching, but also a progressive displacement of the pinched zone, so as to provoke a "roll" while at the same time exerting pressure.

French Pat. No. FR-A-2 057 514 has already proposed an apparatus, which, to a certain extent, could have enabled such a type of "rolled palpation" massage to be carried out.

The apparatus described in No. FR-A-2057514 generally comprises, mounted inside a manually operated housing, two parallel rollers driven in rotation by a motor and which are subjected to the action of return springs tending to apply them against each other. Furthermore, a source of suction opens out inside the housing.

An apparatus of this type presents numerous drawbacks following from its design. In fact, according to this document, the two rollers are subjected to the action of springs which tend to apply them against each other and it is the fold of the skin which tends to space the rollers apart. In practice, such a solution is not feasible, since it is not possible to regulate the pinching action exerted by the rollers and that, in order to form the fold of the skin causing spacing apart of the rollers, a considerable vacuum would be necessary, which may traumatize the skin.

Furthermore, the efficiency of such an apparatus appears more than doubtful, being given that suction is exerted freely and at random within the housing, not only between the rollers but also laterally.

Consequently, at the present time, massage treatments in accordance with the "rolled palpation" technique are always carried out by hand, which not only is tiring for the masseur but also does not enable regular treatment to be obtained, since the stresses exerted depend not only on the person carrying out massage, but also on how tired he/she is.

SUMMARY OF THE PRESENT INVENTION

An apparatus has now been found, and this is the subject matter of the present invention, which is of simple design, easy to use, which overcomes the above drawbacks and enables "rolled palpation" massages to be made automatically with adjustable and constant intensity, and this totally independently of the physical capacities of the masseur.

Furthermore, the apparatus according to the invention makes it possible to control with precision the pressure exerted by the rollers during the treatment.

The present invention generally relates to an improvement in massaging apparatus comprising, mounted inside a manually operated housing, two parallel rollers, preferably driven in rotation by a motor, said housing being connected to means for creating a vacuum above the rollers, and it is characterized in that:

the two active rollers are normally maintained in a spaced apart relationship with respect to each other via return means such as springs or the like, the vacuum created within the housing is exerted solely in the space between the rollers during use of the apparatus and tends not only to suck the skin so that it can be treated, but also automatically to bring the rollers closer to each other to ensure the pinching action on the fold of skin formed.

Advantageously, in practice:

although the two rollers may be mounted to rotate freely on the housing, at least one of the rollers, and generally both, are preferably driven positively, for example by a gear motor supplied with direct current, by means of a cell or battery, allowing regulation of the speed of displacement and the direction of the gear motor which may automatically be reversed as a function of the direction of displacement of the apparatus;

the pins on which the two rollers are mounted may slide in slots provided on the lateral walls of the housing; sealing valves are provided on the faces of the housing to obturate the slots during the displacements of the rollers;

pivoting flaps are disposed inside the housing and come into contact with the rollers over the length of their generatrix, so as to define a suction chamber; these pivoting flaps remain permanently in contact with the rollers during their displacement, this being obtained by the action of the vacuum and/or of return springs, as for the sealing valves provided on the lateral faces of the housing for obturating slots in which the ends of the pins of the rollers slide;

according to a variant embodiment, the rollers may be slightly eccentric on their axis or not be cylindrical, so as to obtain an automatic variation of the pressure during the massaging operation; possibly, one roller only may be eccentric or is not cylindrical;

the different controls and functions of the apparatus are obtained by means of a control assembly which is essentially constituted by a panel, connected to the treating apparatus proper by a flexible conduit, this panel containing sub-assemblies ensuring operation of said apparatus, namely in particular:

a vacuum pump and its motor integrated therewith, a filter at the inlet of the pump, a plate supporting electro-valves allowing the controlled regulation of the depression, means (for example electronic cards) for ensuring control and monitoring of an electro-pneumatic servo-control chain, electrical supply means.

The invention will be more readily understood on reading the following description with reference to the accompanying drawings, in which:

DETAILED DESCRIPTION OF THE INVENTION

Figure 1:
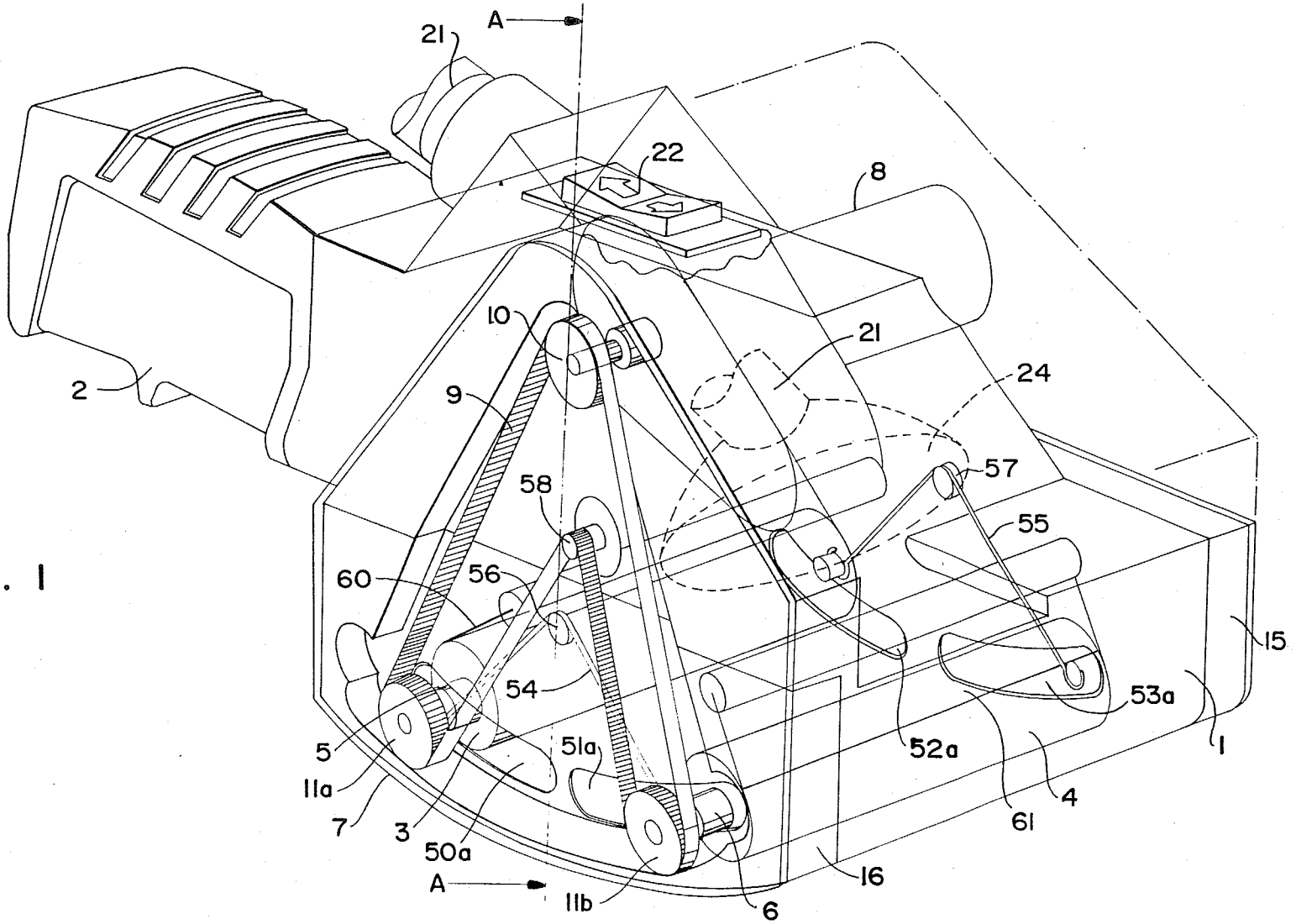
FIG. 1 is a view in perspective showing the principal members of an apparatus according to the invention.
Figure 3:
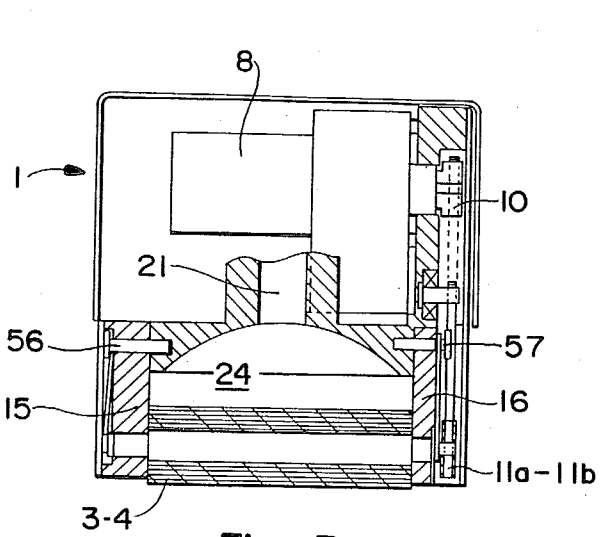
FIGS. 2, 3 and 4 are views in longitudinal section, transverse section and in plan, respectively, of an apparatus according to the invention.

Referring now to the drawings, the massaging apparatus according to the invention is in the form of an assembly constituted essentially by a housing (or head) designated by general reference 1 and which may be obtained by moulding. This housing 1 (or head) contains the active elements and may be displaced by means of a handle 2 which is attached thereto or integral therewith. Since the handle is disposed in the axis of the housing, it displacement of the assembly both by the right hand and by the left is possible.

The active elements include by two rollers 3, 4 mounted inside the housing via pins 5, 6. Rollers 3, 4 may either be mounted concentrically to pins 5, 6 or may be slightly eccentric to, enable a variation of the pinching effect obtained.

According to this embodiment, the lower face 7 of the housing is preferably slightly concave and not flat. Furthermore, the periphery of the two rollers 3, 4 preferably projects slightly from the lower surface 7 of the housing by a value generally of the order of 0.5 to 1 mm.

In accordance with the invention, the two rollers 3, 4 are normally maintained spaced apart from each other on either side of a plane of symmetry AA and the pins of said rollers are received in slots 50, 51, 52, 53 which have the same radius of curvature as the bottom 7 of the housing, or a slightly smaller radius of curvature. The rollers are maintained in spaced apart relationship with respect to each other by means of two springs 54, 55, for example of the hair pin type. The ends of each of the shafts of each spring act on the pins of the rollers and the central part of the spring is mounted on a fixed point 56, 57 located on the plane of symmetry AA of the apparatus.

In order to ensure air tightness at the level of slots 50, 51, 52, 53, lateral valves 50*a*, 51*a*, 52*a*, 53*a* are associated with the rollers. Such valves may be adapted to be displaced simultaneously with the rollers, in which case the slots will be slightly offset with respect to one another so that the lateral valves may come into superposition and slide to ensure tightness by superposition.

Figure 5:
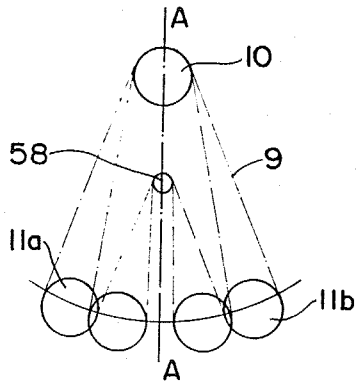
FIG. 5 is a view in detail showing the manner in which the automatic displacement and drive of the two rollers are effected.
Figure 2:
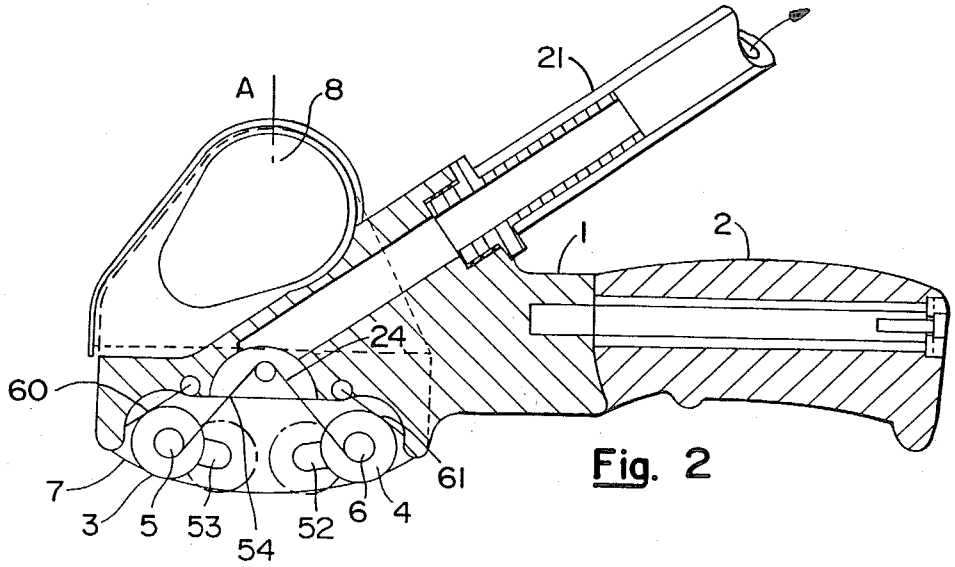
Figure 4:
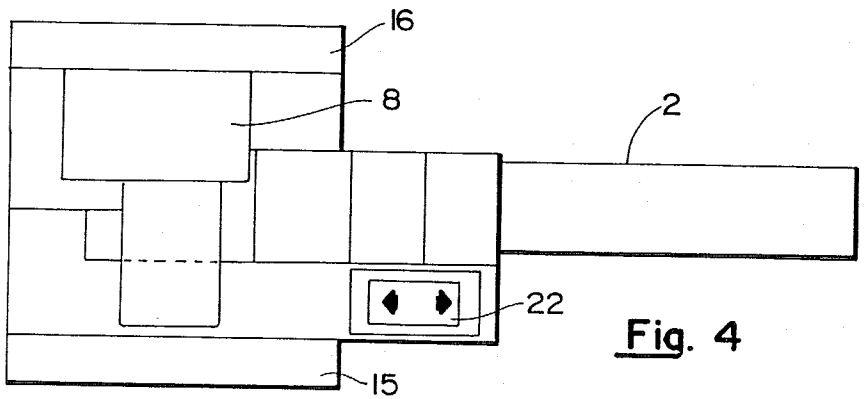

Furthermore, the two rollers 3, 4 are, in the present case, driven positively in rotation. It is obviously not beyond the scope of the invention to provide by an apparatus where there is no positive drive of the rollers, wherein rotation is obtained by the action of the user. Positive drive is obtained in the present case via a gear motor 8 of 24 volts, for example, with or without variation of speed. The movement imparted by motor 8 is transmitted to the two rollers 3, 4 via a synchronous belt 9 connecting the driven shaft 10 of the motor and two pinions 11*a*, 11*b* provided at the end of each of the pins 5, 6 of the rollers 3, 4. Belt 9 also passes around an intermediate guide roller 58 so that the two rollers rotate in the same direction and are always driven well whatever their position. The assembly is designed so as to be able to obtain, as shown in FIG. 5, a displacement of the two rollers with respect to plane AA. Adjustable means are provided so that, when the direction of rotation of the rollers is reversed, suction is maintained inside the head.

As shown in the drawings the space between rollers 3, 4 and the interior of the housing 1 is, designed so as to create a vacuum in this space. To this end, a source of suction is connected to the housing via a conduit 21 which opens out on the top of the housing 1 and forms a chamber 24 which extends over the whole width of the space between the lateral faces 15, 16 constituted by cheeks connected to said housing 1. Possibly, one of the lateral faces may form an integral part of the housing, the second being added thereto.

In order to ensure air tightness at the periphery of the rollers, flaps 60, 61 are pivotally mounted on a pin and abut the outer faces of said rollers, over the whole length thereof. These flaps may for example be constituted by a simple metal or plastic blade. They remain permanently in contact with the rollers during displacement thereof. In this embodiment, this is automatically obtained by the suction action of the vacuum alone, but it may be envisaged to add to the flaps additional return means such as springs for example. Moreover, these flaps pressing on the rollers due to the vacuum accentuate the pressure of said rollers.

Finally, means constituted for example by a control button or switch 22 are provided on the handle 2 to allow an operator to start, stop, or reverse the direction of rotation of motor 8, and to control the suction. A timing system, of about two to three seconds, is provided in order to avoid stoppage of the vacuum system 21 when the direction of rotation is reversed, as indicated above.

Figure 6:
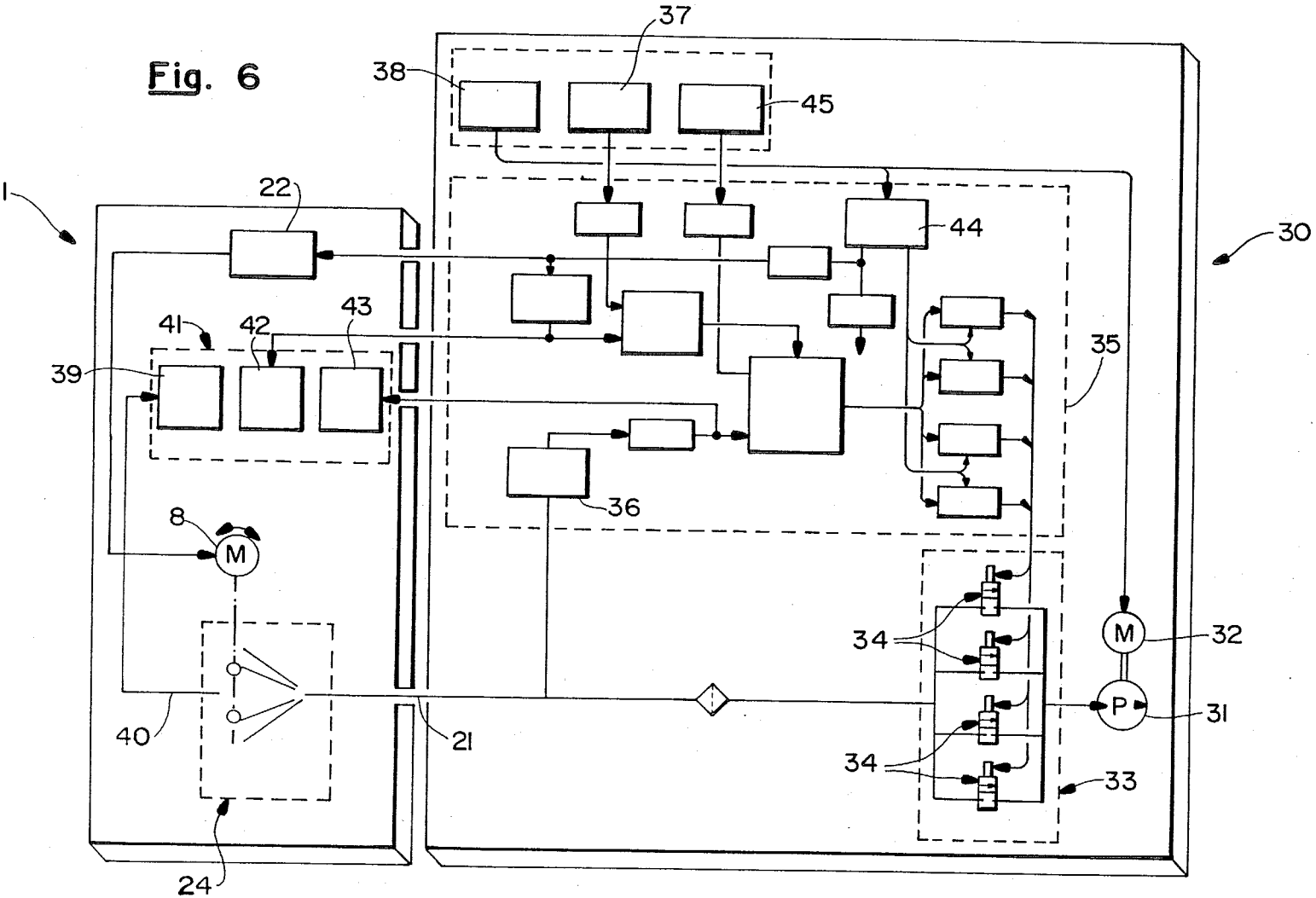
FIG. 6 is a schematic diagram illustrating the means for controlling and monitoring the different functions performed by the apparatus according to the invention.

The manner in which the different functions and controls of an apparatus according to the invention are performed is illustrated in the block diagram of FIG. 6.

As shown in this Figure, housing 1 is connected via a flexible conduit 21 to a panel generally designated by reference numeral 30 in which are grouped together the assemblies ensuring operation of such an apparatus, namely, in particular:

- a vacuum pump 31 comprising a motor 32 integrated therein;
- a plate 33 for supporting four electro-valves 34 ensuring the controlled regulation of the vacuum inside the head;
- an electronic circuit 35 for controlling and monitoring an electro-pneumatic servo-control chain;
- electrical supply means 44.

In the pneumatic circuit connected to the head of the apparatus, there is disposed a filter adapted to avoid suction of dust by the vacuum pump. Furthermore, a vacuum sensor 36, mounted in shunt upstream of the treatment chamber, serves as element for measuring the vacuum obtained in order to give the necessary information to the servo-control chain.

The servo-control chain proper of the apparatus according to the invention is essentially constituted by the control circuit of the electro-valves 34, which receives two items of information at input, namely:

- the reference signal obtained from a value programmed on a code wheel 45 of the vacuum sensor;

the real signal obtained from the electrical information delivered by the pressure sensor 36 mounted on the pneumatic circuit.

This circuit elaborates the four independent controls relative to each electro-valve 34, so as to obtain a variation close to 0 between the real value and the reference value. This circuit is validated only in the presence of the control of the kinematic chain; its validation is obtained after disappearance of this control for the timing period programmable by the code wheel 37 to maintain the fold of skin, for example for a possible restart in the opposite direction.

The control assembly of the apparatus according to the inventiin comprises additional circuits, including, for example:

means 39 giving information on the position of the rollers mounted on the housing 1 and constituted by a series of position sensors 40 disposed on the path of the pin of the rollers and which enable the information on absolute position with respect to the stops of each of said rollers and their relative spaced apart relationship, to be elaborated; such information is displayed via a luminous scale 41 constituted for example by twenty colored light emitting diodes (LEDs);

means 42 giving information on rotary pressure of the rollers; these means are constituted by a circuit for measuring the driving torque of the kinematic chain which allows assessment of the resistance of the subcutaneous tissue to the rolling, hence the rotary pressure of the rollers; this information is displayed via a luminous scale constituted for example by 12 colored LEDs;

finally, information on the value of the vacuum obtained via a vacuum sensor 36, this value being applied to a luminous scale 43 likewise constituted by 12 colored LEDs.

A massaging apparatus of this type operates as follows. After having switched on the apparatus by control 38 and programmed the automatic monitoring and servo-control system (value of the vacuum as a function of the treatment, value of timing of maintenance of the vacuum), the operator applies the lower face of the housing 1 against the patient's body, exerting a slight pressure and controlling, via switch 22, on the one hand the vacuum produced by means of conduit 21 inside the chamber 24 formed within the housing 1 and between the rollers 3, 4 and, on the other hand, the rotation of said rollers. The vacuum produced inside the chamber 24 provokes suction and pinching of the skin and tends automatically to move the two rollers 3, 4 towards each other to exert a pressure on the skin imprisoned therebetween. It is therefore possible to pinch more or less firmly, as a function of the value of the vacuum created in the chamber. Consequently, pressure is obtained on the skin, as a function of the pre-adjusted vacuum obtained inside the chamber 24 located above the rollers, at the same time as a rolling of the zone pinched between the surfaces 3, 4 driven in rotation.

When the masseur releases switch 22, rotation of the rollers is interrupted and suction is maintained for the programmed duration. To obtain massage in the opposite direction, the masseur actuates switch 22 on the opposite side.

An apparatus of this type, of particularly simple design and use, operating virtually automatically, is not only very efficient, as the action exerted by the rollers is constant and may be adjusted precisely, but is also felt by the majority of patients as more pleasant and less painful than a manual massage.

The invention is, of course, not limited to the embodiment described hereinabove, but covers all the variants thereof made in the same spirit. For example, the two rollers may be driven by a means other than a synchronous belt, for instance by means of a flat, round or triangular belt, or even by chains or gears.

Furthermore, it is also possible to produce the apparatus of different dimensions. For example, although in the embodiment described hereinabove the active rollers have a length of 65 mm and a diameter of 24 mm, it may be envisaged to produce a much smaller apparatus, for example having rollers 30 to 40 mm long and with a diameter smaller than that of the preceding diameter, and this in order to treat smaller zones.

Finally, although the apparatus is preferably used with a specific control assembly, in certain cases it may be envisaged to supply it directly from sources of suction avilable in situ, for example, in hospitals, or even by connecting it to the outlet of a household vacuum cleaner.

What is claimed is:

1. A massaging apparatus for massaging a human body, said apparatus comprising:

a housing;

a vacuum chamber formed in said housing;

two rollers, each roller having an outer periphery and an axis and being rotatably mounted in said housing, said axes of said two rollers being parallel;

a variable size passage communicating said vacuum chamber with the exterior of said housing, said passage being defined in part by said rollers;

return means for biassing said rollers away from one another so as to increase the size of said passage;

means associated with the roller to seal in the vacuum chamber; and vacuum means for evacuating air from said vacuum chamber so as to create a vacuum in said vacuum chamber.

2. The massaging apparatus of claim 1, wherein said rollers are mounted in said housing for arcuate movement toward and away from one another.

3. The massaging apparatus of claim 1, wherein said apparatus includes a reversible motor for imparting rotation to said rollers.

4. The massaging apparatus of claim 3, wherein a synchronous belt transmits rotation from said motor to said rollers.

5. The massaging apparatus of claim 3 further comprising an operator control button for starting said motor and selecting a direction of motor rotation.

6. The massaging apparatus of claim 5, wherein said control button also controls operation of said vacuum means such that when said motor is started said vacuum means begins to create a vacuum in said vacuum chamber; and wherein a timing means is provided for maintaining said vacuum in said vacuum chamber for a predetermined time period after said control button is operated to reverse the rotation of the motor.

7. The massaging apparatus of claim 1, wherein said rollers include pins which are slidably received within slots formed in said housing, and slot sealing means for sealing said slots along a portion thereof extending between said rollers.

8. The massaging apparatus of claim 1, further comprising sealing flaps mounted in said housing, said sealing flaps being constantly biassed into contact with the periphery of said rollers to provide substantially air tight sealing between said housing and said rollers.

9. The massaging apparatus of claim 8, wherein said sealing flaps are biassed into contact with said rollers by said vacuum.

10. The massaging apparatus of claim 9, wherein said sealing flaps are pivotably mounted in said housing.

11. The massaging apparatus of claim 10, wherein said sealing flaps are spring biassed into contact with said rollers.

12. The massaging apparatus of claim 1, wherein at least one of said two rollers is mounted for rotation about an axis which is eccentric with respect to the axis of the outer periphery of said at least one roller.

13. The massaging apparatus of claim 1, wherein the exterior of said housing includes a concave inner face, the outer periphery of said rollers projecting from said inner face.

14. The massaging apparatus of claim 1, further comprising means for adjusting the degree of evacuation of air from said vacuum chamber so as to vary the amount of vacuum created in said vacuum chamber.

15. A massaging apparatus for massaging a human body, said apparatus comprising:

a housing;

a vacuum chamber formed in said housing;

two rollers, each roller having an outer periphery and an axis and being rotatably mounted in said housing, said axes of said two rollers being parallel;

a variable size passage communicating said vacuum chamber with the exterior of said housing, said passage being defined in part by said rollers;

return means for biassing said rollers away from one another so as to increase the size of said passage;

vacuum means for evacuating air from said vacuum chamber so as to create a vacuum in said vacuum chamber; and means associated with the rollers to seal in the vacuum chamber;

wherein when said massaging apparatus is applied to the skin of a human body and a vacuum is created in said vacuum chamber, said vacuum sucks skin into said passage between said rollers and biasses said rollers toward one another in opposition to the bias of said return means.

* * * * *